US006231713B1

(12) United States Patent
Iams

(10) Patent No.: US 6,231,713 B1
(45) Date of Patent: May 15, 2001

(54) METHOD AND APPARATUS FOR FORMING A PERMANENT CREASE IN A CLOTH

(76) Inventor: Paul L. Iams, R.D. #1, Box 52, Jefferson, PA (US) 15344

( * ) Notice: Subject to any disclaimer, the term of this patent is extended or adjusted under 35 U.S.C. 154(b) by 0 days.

(21) Appl. No.: 09/317,548

(22) Filed: May 24, 1999

(51) Int. Cl.[7] ..... D06J 1/00; D06J 1/06

(52) U.S. Cl. ..... 156/227; 223/30; 223/31; 223/38

(58) Field of Search ..... 223/38, 30, 31, 223/72; 427/393.2; 156/227, 285

(56) References Cited

U.S. PATENT DOCUMENTS 4,036,414 * 7/1977 Miranda ..... 223/28
4,182,264 * 1/1980 Gibson et al. ..... 118/306
5,897,734 * 4/1999 Sugihara ..... 156/228

* cited by examiner

*Primary Examiner*—Michael W. Ball
*Assistant Examiner*—Barbara J. Musser
(74) *Attorney, Agent, or Firm*—Clifford A. Poff

(57) ABSTRACT

An apparatus includes an elongated cloth support having gaps wherein crease blades pass folded portions of cloth for creasing. Heated presser bars are spaced apart to receive selected portions of cloth passed from the gap by the crease blades into gaps between the presser bars which operate to apply pressure for creasing portion of cloth between the press bars. Elongated crease blades are lifted vertically from between the presser bars to allow additional creasing by the press bars under increased pressure. After creasing the presser bars are separated and elongated crease support bars are moved vertically to engage the crease for unfolding the reversely extending cloth portion while supported along a crease line. Filler applicators are positioned downwardly in close proximity to the crease lines for discharging a filler along the crease lines while supported by the elongate crease support bar.

28 Claims, 16 Drawing Sheets

METHOD AND APPARATUS FOR FORMING A PERMANENT CREASE IN A CLOTH

BACKGROUND OF THE INVENTION

1. Field of the Invention

The present invention relates to a method and apparatus for forming a crease in a cloth and, more particularly, to providing a crease in cloth of a permanent nature such that the crease is capable of withstanding repeated laundering and steam pressing without degradation to the esthetic appearance as part of a garment.

2. Description of the Prior Art

While not so limited, the present invention is particularly useful for forming a decorative type crease, such as a military crease, in cloth before the cloth is sewn to form any of various types of clothing/garments. Uniforms worn by military personnel, police, firefighter and other personnel imparting an image of distinctive dress codes are provided with ornate crease lines usually extending vertically along the front and back portions of a shirt with the creases ending short of the shirt yoke and the shirt tails.

In the past, the creases were formed by forming fold lines in a starched laden garment and then steam pressing the garment along each of the fold lines. The forming of creases in this matter required multiple pressing operations, one pressing operation for each crease line. Creases in cloth are also commonly found in trousers, skirts particularly pleated skirts, blouses and dresses. To achieve a more permanent nature of the crease lines, it is known to sew the cloths along fold lines which is very labor intensive requiring skilled seamstress and therefore represents an added element of cost.

It is also known to provide crease lines in cloth of a permanent nature by manually applying a stream of liquid material, such as silicone, to the cloth along a valley formed by a crease line in the cloth. A workman first forms a crease line in the cloth then applies the stream of liquid solvent-based material and repeats this process to achieve a desired number of crease lines. A liquid solvent-based filler material is available with physical properties providing the capability of withstanding temperatures of 400 degrees F. without melting. The required manipulative steps in the manual process of forming crease lines and applying filler material is labor intensive without an effective quality control. A need therefore exists for a method and apparatus to establish creases in cloth with long continued integrity, accuracy and without degradation to the esthetic appearance during the useful life of the apparel.

Accordingly, it is an object of the present invention to crease a displaced part of a cloth while supported in a stable manner along a course and then unfold marginal portions of the cloth while supporting the cloth along the crease line so that the marginal portions expose the crease line while a filler strip is applied along the crease line.

It is a further object of the present invention to crease a first displaced part of cloth while supported in a stable manner along a course followed by displacing and creasing a second and if desired a third displaced part of the cloth and then unfold marginal portions of the cloth adjoining each of the crease lines and then support the cloth along each crease line so that the marginal portions exposed the crease lines while an elongated bead of filler material is applied to each crease line.

SUMMARY OF THE INVENTION

According to the present invention there is provided a method for providing a permanent crease in a cloth, the method including the steps of arranging a select cloth along a course traversing an elongated gap formed by spaced apart supports, forming reversely extending cloth portions by displacing a part of the select cloth through the gap and into an elongated gap between presser members, creasing the reversely extended cloth portions residing in the elongated gap between presser members to form an elongated crease line between the reversely extending cloth portions, unfolding the reversely extending cloth portions to expose the elongated crease line, and adhering a filler to the select cloth along at least a part of the elongated crease line to establish a permanent crease of long continued integrity.

The method of the present invention is further defined by the steps of arranging a select cloth along a course traversing a plurality of spaced apart and elongated gaps between support members, forming first reversely extending cloth portions by displacing a first part of the select cloth through a first gap of the plurality of gaps and into an elongated gap between first presser members, gripping the reversely extended cloth portions residing in the elongated gap between the presser members, forming second reversely extending cloth portions by displacing a second part of the selected cloth through a second gap of the plurality of gaps and into an elongated gap between second presser members, creasing the first and second reversely extending cloth portions residing in the plurality of elongated gaps between each of the first and second presser members to form elongated first and second crease lines, unfolding the first and second reversely extending cloth portions to expose each of the first and second elongated crease lines, and adhering a filler along at least a part of each of the first and second elongated crease lines to the select cloth to establish military creases in the cloth of long continued integrity.

The present invention further provides an apparatus to form a military crease in cloth by the combination of an elongated cloth support having at least one gap for passage of a folded portion of cloth, elongated press bars movable to a spaced apart relation to receive a select portion of cloth passed from the gap in the cloth supports, a press bar actuator connected to the press bars for displacing the press bars into a creasing position to crease a portion of cloth between the press bars, an elongated crease blade reciprocal along a generally parallel path of travel between an inoperative position remote to the elongated cloth support and along a course of travel to displace a portion of cloth from the support to an operative position formed at a site between the press bars to an operative position, a crease support bar for unfolding the reversely extending cloth portion while supporting the cloth along a crease line, a crease support bar actuator for moving the crease support bar between a cloth receiving position between the press bars and a cloth support position for the application of a crease line filler and an applicator for discharging a crease line filler along the crease line while supported by the elongate crease support bar.

BRIEF DESCRIPTION OF THE DRAWINGS

The present invention will be more fully understood when the following description is read in light of the accompanying drawings in which.

DETAILED DESCRIPTION OF THE PREFERRED EMBODIMENT

Figure 1:
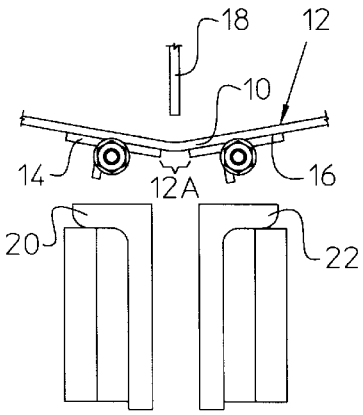
FIGS. 1–5 are schematic illustrations of the sequence of manipulating part of a cloth to produce a permanent crease according to the present invention.

Schematically illustrated in FIGS. 1–5 is the sequence of movements by components of apparatus according to the present invention to treat a cloth for imparting a permanent crease. In FIG. 1, a select cloth 10 is placed on a table 12 formed by a pair of table plates 14 and 16 arranged to form, in cross section, a trough shaped cloth support surface. The table plates 14 and 16 are spaced apart to form a gap traversed by the cloth when placed on the table. A thin, elongated crease blade 18 is moved from a remote position above the cloth into contact with a cloth to displace a portion of the cloth through a gap 12A formed by confronting opposed side edges of the table plates 14 and 16 and into a gap between spaced apart presser bars 20 and 22.

Figure 2:
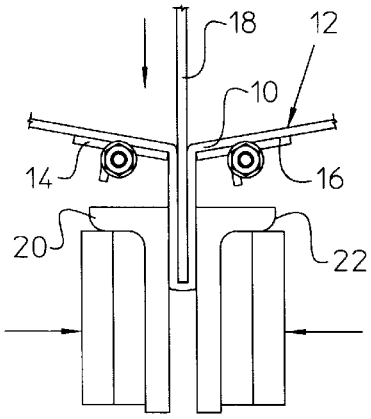
Figure 3:
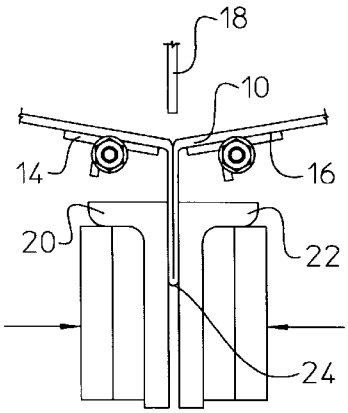

In FIG. 2, the crease blade 18 is shown in a fully displaced position whereby a small length of cloth containing a reversely bent portion formed by a wrapping of the cloth about the leading edge of the crease blade residing in the gap between the presser bars 20 and 22. The presser bars are preferably heated to enhance the definition of the crease line in the cloth. An actuator is operated to move the presser bars in a direction toward each other under a sufficient force to pinch the cloth in the gap between the presser bars and the crease blade 18. The pressure on the crease blade is sufficiently low to allow withdrawing of the crease blade from the site between the press bars without carrying with it the reversely bent portion of the cloth. As shown in FIG. 3, after the crease blade is withdrawn from the cloth, the press bars are pressed tightly against the reversely bent portion of the cloth under sufficient force and temperature to impart a concisely defined elongated crease line 24 between reversely extending cloth portions 26 and 28.

Figure 4:
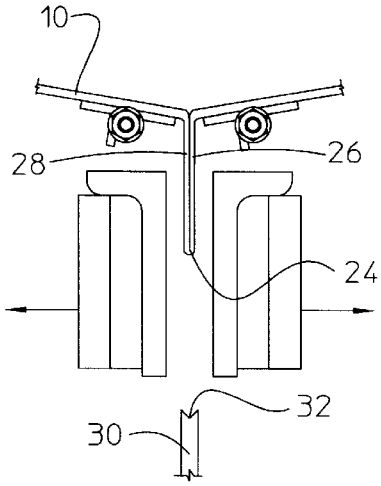
Figure 5:
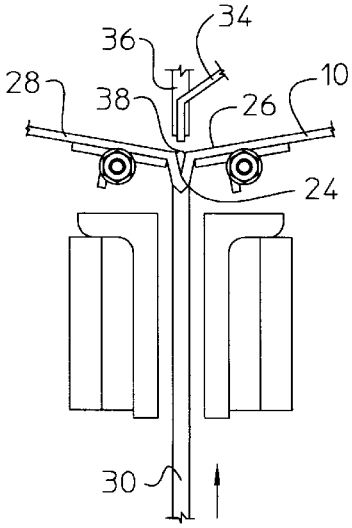

As shown in FIG. 4, after a crease line 24 is formed, the press bars are separated to reestablish a gap between the press bars which is sufficient to allow an elongated crease support bar 30 having a "V" shaped trough 32 to engage the exterior edge of the reversely extending cloth portions. The "V" shaped trough functions to align the crease line along the cloth in the valley of the crease support bar. As the crease support bar is elevated to a support position shown in FIG. 5, the reversely extending cloth portions unfold and separate to extend from the crease line and exposing the interior notch of the crease. After the creased line is centered to extend along the "V" shaped notch, pressure is applied along the crease line to stabilize and firmly seat the marginal portions of cloth at the crease line against the surface of the "V" shaped trough. The pressure to seat the cloth is provided by directing streams of pressurized air from air discharge nozzles 34 centered on the crease line 24. A stream of liquid filler is discharged from a nozzle 36 situated above the crease line and advanced along the length of the crease line while the cloth is stabilized along the crease line by the streams of air.

One suitable filler material is an air curing, solvent based, silicone, series 100 available from General Electric Company. This silicone material in bead, film or thin layer forms exhibits elasticity and adherence to the cloth sufficiently to retain the desired appearance of a distinctive crease line while the garment undergoes stress and strain in response to body movements and during the usual laundering operations. Other suitable filler materials include thermal setting and thermal plastic materials formulated to provide a melting point compatible with the particular cloth material. The composition of certain cloth, particularly when incorporating synthetic materials, is known to sustain damage when exposed to high temperatures and therefore care must be exercised to avoid thermal damage to the cloth during the application of a bead, film or layer of heated filler material. The seating of the cloth by the streams of air discharged by nozzles 34 also serves to stabilize the reversely extending cloth portions against table plates 14 and 16 so that the discharge nozzle 36 functions to accurately place the filler material precisely along the crease line and form, upon solidification of the filler material, a uniformly sized bead 38 along the extending length of the crease.

The preferred embodiment of apparatus for forming a permanent crease line in a cloth which is also useful to carryout the preferred method according to the present invention is shown in FIGS. 6–14. There are one or more of three discrete, spaced apart cloth creasing stations each embodying an arrangement of major components as just described and illustrated in FIGS. 1–5 to form discrete crease lines in a select cloth. The selected number of creasing stations is dependent on the desired number of crease lines to be formed in a select cloth.

Figure 8:
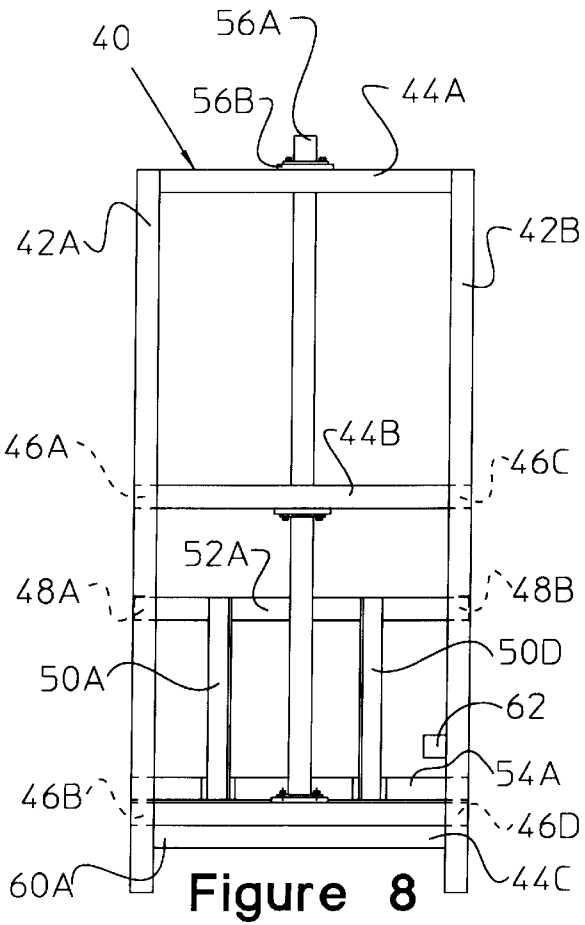
FIG. 8 is an elevational view of the structural framework at the right-hand side thereof, the elevational view of the left-hand side being duplicated.
Figure 7:
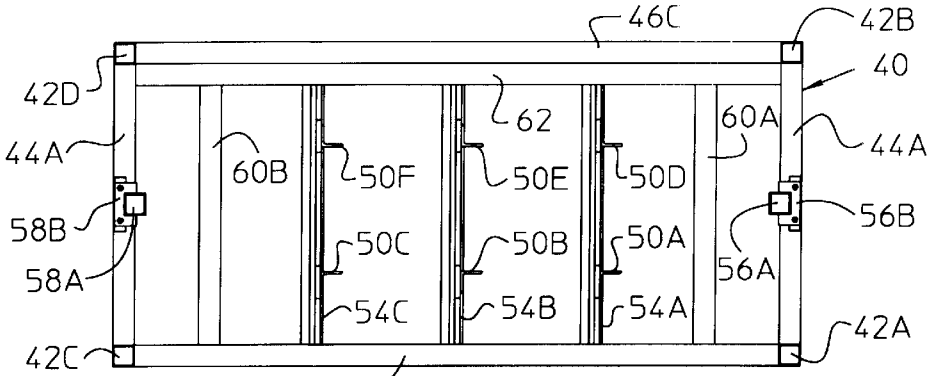
FIG. 7 is a plan view of the structural framework shown in FIG. 6.
Figure 6:
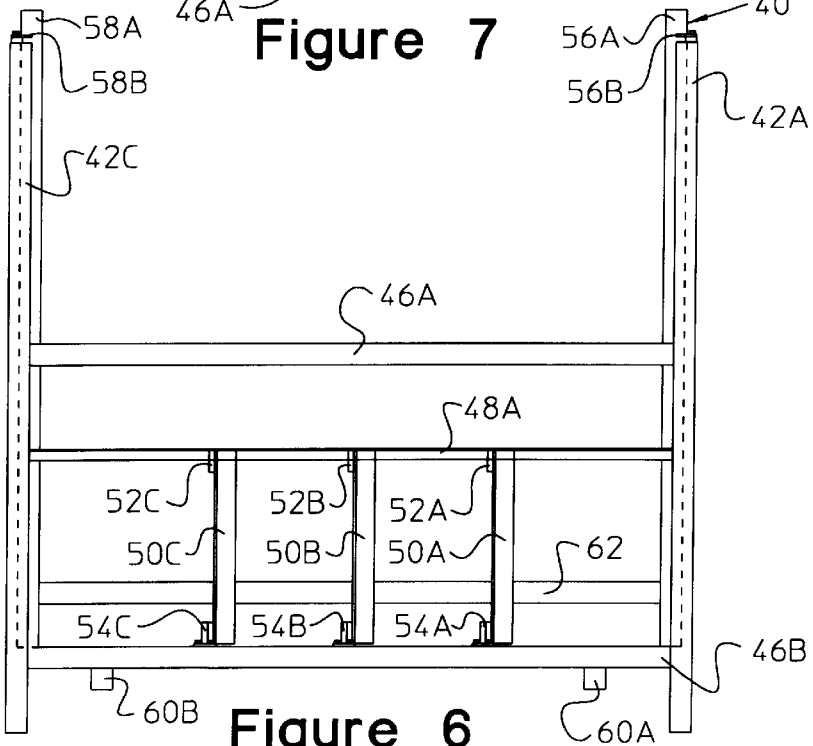
FIG. 6 is a front elevational view of a rectangular structural framework forming part of the apparatus for producing a permanent crease in a cloth according to a preferred embodiment of the present invention.

As shown in FIGS. 6, 7 and 8, the apparatus includes a structural framework 40 which includes four upstanding corner columns 42A, 42B, 42C and 42D. These columns are arranged as follows: column 42A is situated at the right front; column 42B at the right rear; column 42C at the left front; and column 42D at the left rear. Top, middle and bottom horizontal side spacers 44A, 44B and 44C, respectively, are secured to and traverse the space between the columns 42A and 42B at the right of the structural framework and columns 42C and 42D at the left of the structural framework. Secured to columns 42A and 42C at the front of the structural framework are a middle spacer 46A and a carrier bar 46B which also function as a lower spacer. Secured to columns 42B and 42D at the rear of the structural framework are a middle spacer 46C and a carrier bar 46D which also function as a lower spacer. Front and rear channel supports 48A and 48B are secured to the front columns 42A and 42C and rear columns 42B and 42D, respectively, at a spaced relation above carrier bars 46B and 46D.

Six lengths of angle iron 50A, 50B, 50C, 50D, 50E and 50F are arranged in a spaced apart, vertically extending relation and secured at their top ends to horizontal mounting plates 52A, 52B and 52C which in turn are secured to the front and back channel supports 48A and 48B. Similarly the bottom ends of the six lengths of angled iron 50A, 50B, 50C, 50D, 50E and 50F are secured in their respective spaced apart and vertically extending relation to horizontal, "T" shaped, mounting brackets 54A, 54B and 54C which in turn are secured to the front and back carrier bars 46B and 46D. Midway between front column 42A and rear column 42B there is a vertically arranged bearing support tube 56A secured by brackets 56B to each of the upper, middle and lower side spacers 44A, 44B and 44C. Similarly, midway between front column 42C and rear column 42D there is a vertically arranged bearing support tube 58A secured by brackets 58B to each of the upper, middle and lower side spacers 44A, 44B and 44C. Drive support structure is included in the structural framework to perform the movement of parts as described in regard to FIGS. 1 and 5. The drive support structure takes the form of spaced apart and horizontally extending support tubes 60A and 60B secured to the undersurface of carrier bars 46B at the front and rear of the structural framework. A carriage drive support bar 62 is secured to the right rear upstanding column 42B and the left rear upstanding column 42D at a site between the horizontal mounting plates 52A, 52B and 52C and the "T" shaped mounting brackets 54A, 54B and 54C.

As shown in FIGS. 9–11 and 13–15 three creasing stations CS1, CS2 and CS3 are established by an arrangement of parts operatively supported by the structural framework 40. The creasing stations each include one pair of three pairs of table plates 14A, 16A, 14B, 16B, 14C and 16C extending between upstanding carrier plates 64 and secured to the carrier plates 64 by support bars 66 welded to the underside of the table plates. Nut members 66A engage threaded end portions of the support bars 66 which extend through openings in the carrier plate 64 for clamping the table plates in a desired angled orientation relative to each other between the carrier plates 64. This construction and arrangement of parts for securing the table plates to the carrier plates 64 enables positioning of the table plates of each pair and the pairs of table plates to form an undulating configuration to the cloth support surface of table 13. The pairs of table plates 14A, 16A; 14B, 16B; and 14C, 16C are mounted and positioned between the carrier plates to form table gaps 12A, 12B, and 12C between the respective pairs of the associated pairs of table plates for passage of a folded part of cloth into an underlying gap between presser bars. Each carrier plate 64 is secured to a pair of spaced apart support rods 68 extending vertically downward through grommets 68A mounted in apertures formed in laterally spaced crease bar carrier 70 traversing opposite lateral sides of the framework 40 below the cloth support table 13.

Figure 9:
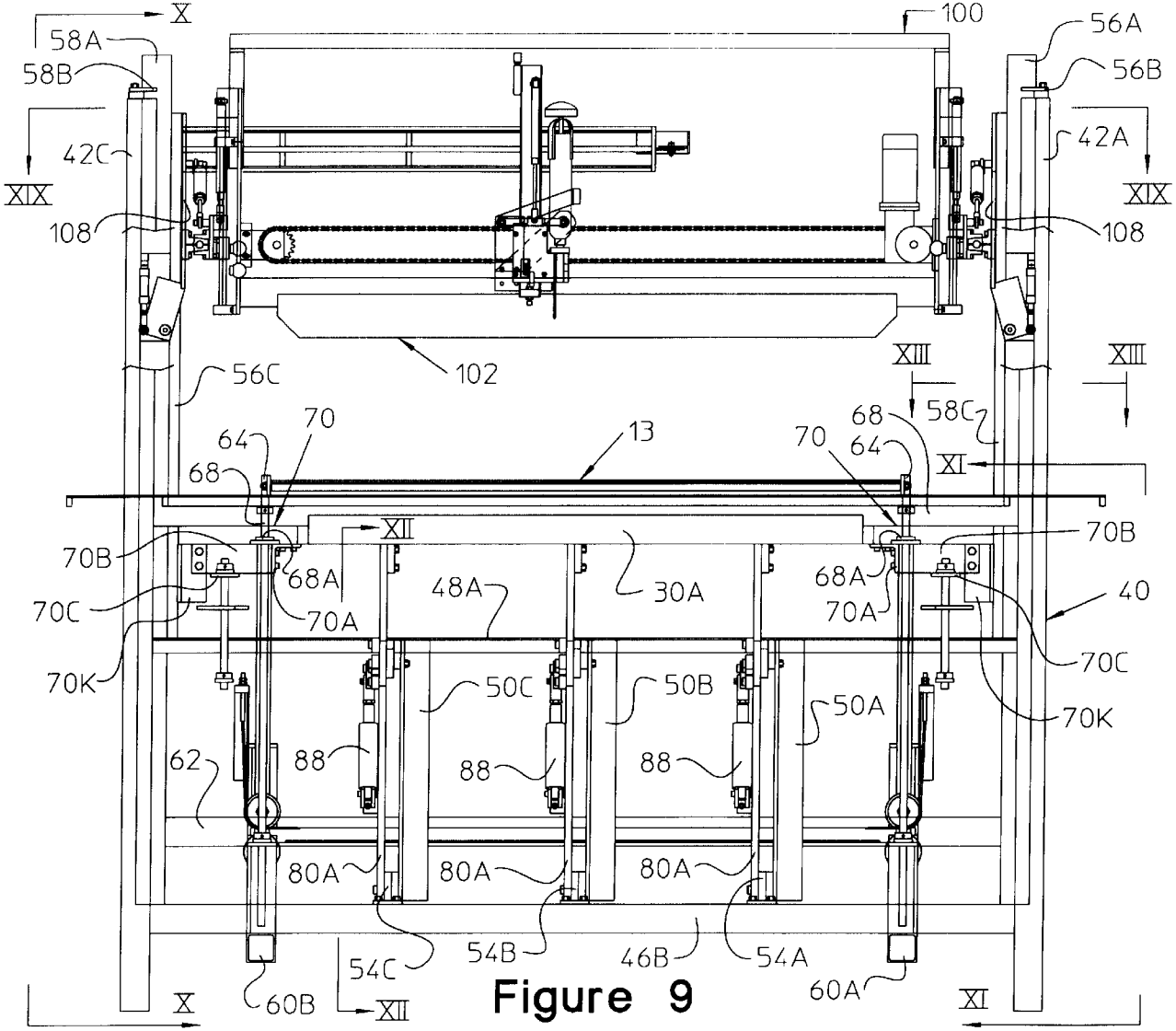
FIG. 9 is a front elevational view of an apparatus for producing permanent crease lines in a cloth according to the preferred embodiment of the present invention.
Figure 13:
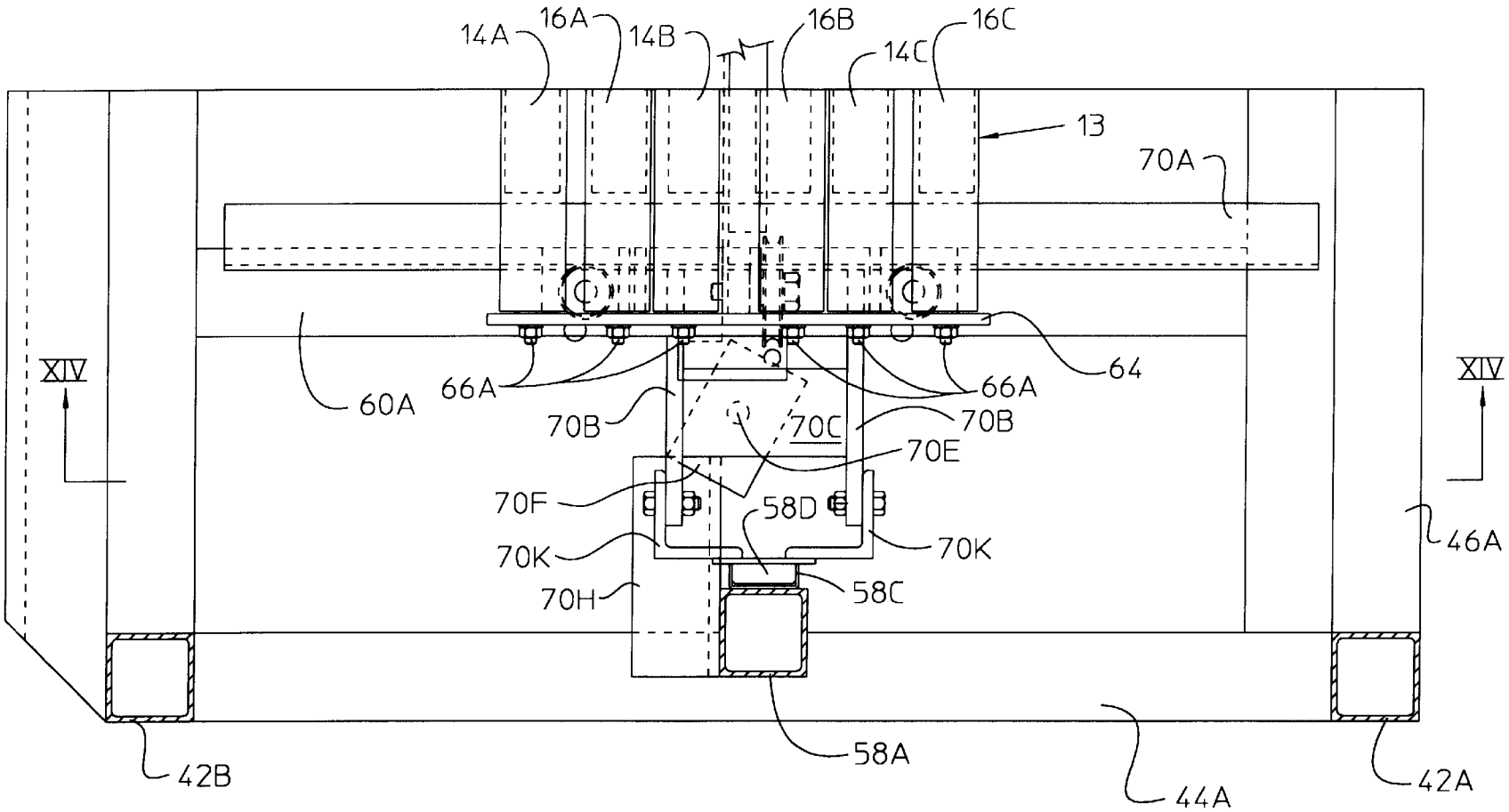
FIG. 13 is a partial plan view taken along lines XIII—XIII of FIG. 9.

As best shown in FIGS. 9–11 and 13–14, the crease bars 30A, 30B, and 30C are arranged in a spaced apart and parallel relation traversing the gap between the crease bar carriers 70 which include "L" shaped support brackets 70A that receive threaded fasteners attaching each of the crease bars to the bracket 70A. The brackets 70A each include a vertical extending leg secured to two spaced apart horizontally extending arms 70B which, in turn, support a horizontal plate 70C. A retainer collar 70D affixed to the upper end of a vertically extending stop rod 70E which passes through an aperture in a stop plate 70F. Affixed to the lower terminal end portion of stop rod 70E is an adjustably positionable stop collar 70G. The stop plate 70F of each crease bar carrier is secured to a horizontally extending bracket 70H (FIG. 15) supported by the associated one of the bearing support tubes 56A and 58A. For each crease bar carrier 70 there is a piston and cylinder assembly 72 used to raise the crease bar carriers 70 and crease bars 30A, 30B and 30C. The crease bar carriers 70 slide along the support rods 68 and near the end of the upward travel by the crease bar carriers, the grommets 68A engage adjustably positionable collars 68D on the support rod 68 for the cloth support table and lift rod 68 and the cloth support table 13 secured to the rods a final short portion of travel by the crease bar carriers 70. In the elevated position of the crease bars and cloth table at the conclusion of the creasing operation the creased portions of the cloth are unfolded as described hereinbefore in regard to FIGS. 1–5 and present reversely extending cloth portions extending from each of the crease lines produced by crease stations CS1, CS2 and CS3 exposing the interior notch along each of the crease lines. Elongated linear bearing tracks 56C and 58C, each having a U-shaped cross section, are secured by threaded fasteners to the support tubes 56A and 58A, respectively. The tracks 56C and 58C extend vertically from a point near the upper terminal ends of the support tubes 56A and 58A downwardly to a point where the lower ends terminate at the elevation of front and rear channel supports 48A and 48B. Linear bearings 56D and 58D are secured to L-shaped brackets 70K that are in turn mounted by threaded fasteners to the spaced apart horizontally arms 70B forming part of the crease bar carriers 70 as best shown in FIGS. 9 and 13.

Figure 14:
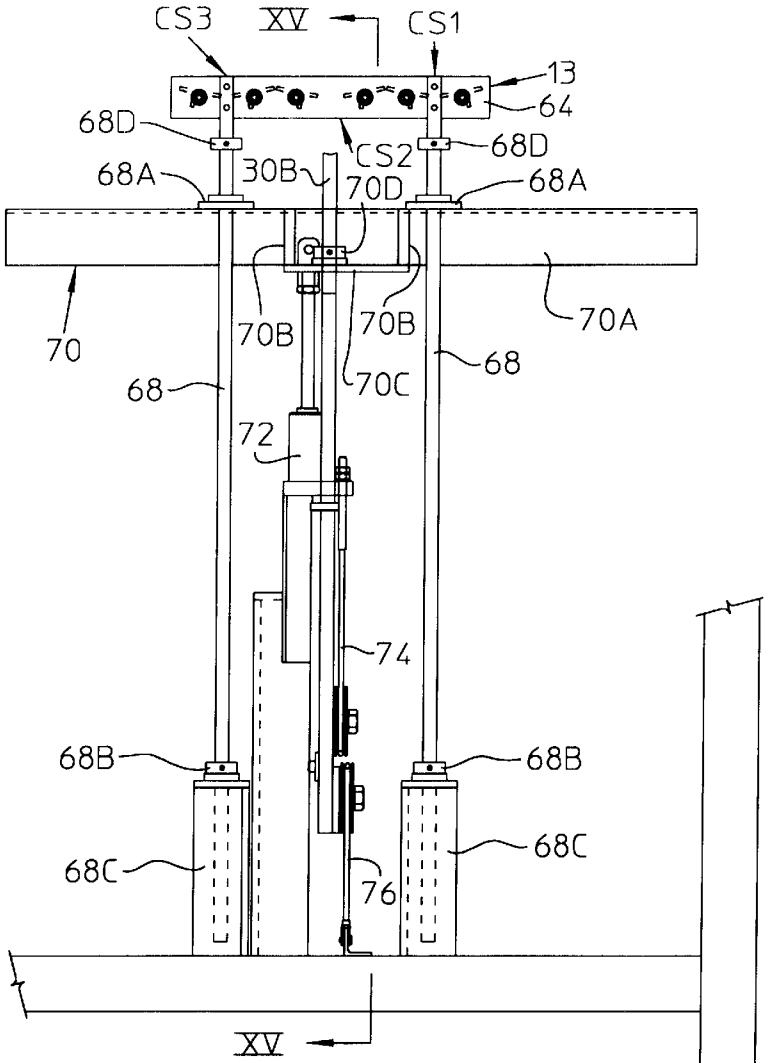
FIG. 14 is a partial elevational view taken along lines XIV—XIV of FIG. 13.
Figure 15:
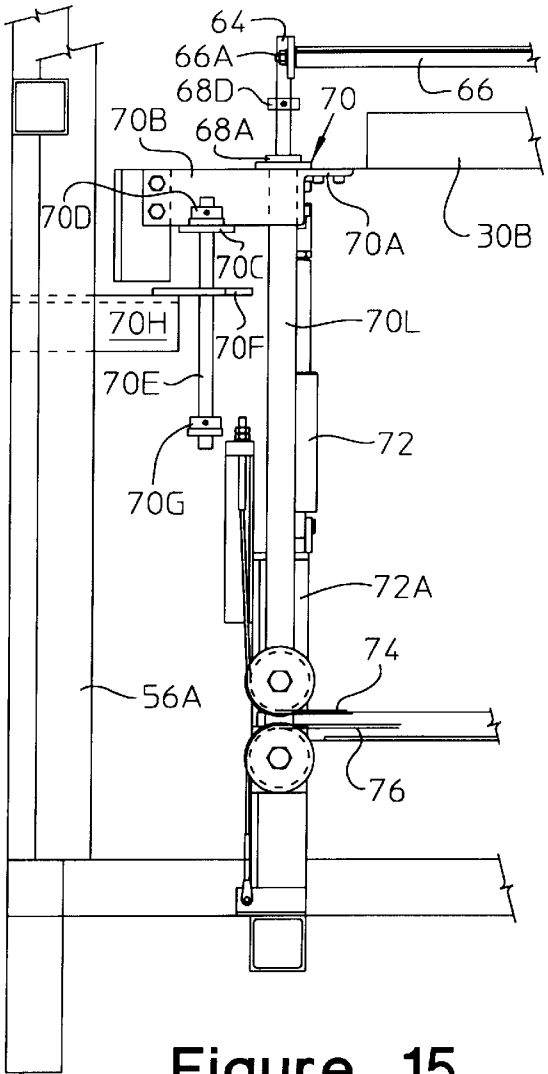
FIG. 15 is a partial elevational view taken along lines XV—XV of FIG. 14.
Figure 16:
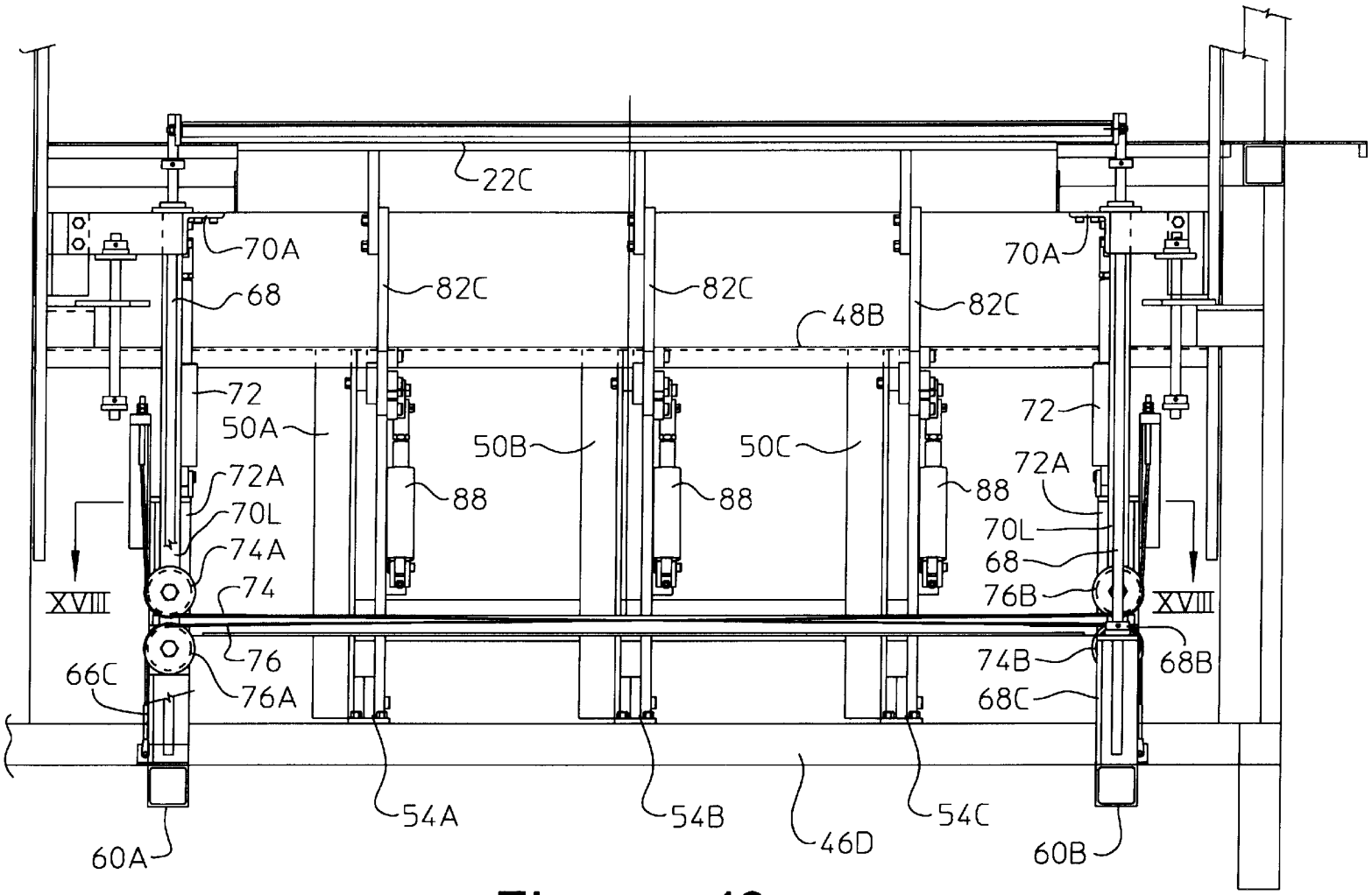
FIG. 16 is a partial elevational view taken along lines XVI—XVI of FIG. 10.

The piston and cylinder assemblies 72, shown in FIGS. 11 and 14–16, are clevis mounted to upstanding pedestals 72A and have rod ends mounted by a clevis to the "L" shaped support bracket 70A. Operation of the piston cylinder assemblies 72 serve to raise and lower the crease bar carriers 70 constrained and guided by the linear bearings for vertical movement along the bearing support tubes 56A and 58A and thereby raise and lower the three spaced apart crease support bars 30A, 30B and 30C between an operative position and a retracted position as described hereinbefore in regard to FIGS. 4 and 5. As best shown in FIGS. 14–16, extending downwardly from the central portion of each of the crease bar carriers 70 is a column 70L. To ensure parallel movement of the crease bars between the operative and inoperative positions, synchronization cables 74 and 76 are arranged in a crossing fashion. End portions of a cable 74 partly wrap about pulleys 74A and 74B rotatably supported on the lower ends of columns 70L at opposite sides of the structural framework 40. The end of cable 74 extending from pulley 74A is anchored by a bracket to support tube 60B and the end of cable 74 extending from pulley 74B is anchored by a bracket supported by column 70L. End portions of a cable 76 partly wrap about pulleys 76A and 76B rotatably supported on the lower ends of columns 70L at opposite sides of the structural framework 40. The end of cable 76 extending from pulley 76A is anchored by a bracket to support tube 60A and the end of cable 76 extending from pulley 76B is anchored by a bracket supported by column 70L. The support rods 68 include adjustably positionable collars 68B positioned along the support rods to bear against stop plates affixed to the upper ends of tubular columns 68C that are in turn supported on support tubes 60A and 60B. The elevation of the cloth support table can be changed by varying the position of the collars 68B along the support rods 68. The cloth support table is elevated between a lower position where crease lines are imparted to the cloth and an elevated position where the unfolded portions of the cloth present the notch of each crease in close proximity to a filler dispensing nozzle which is traversed along the crease line by a trolley drive as will be described hereinafter.

Figure 11:
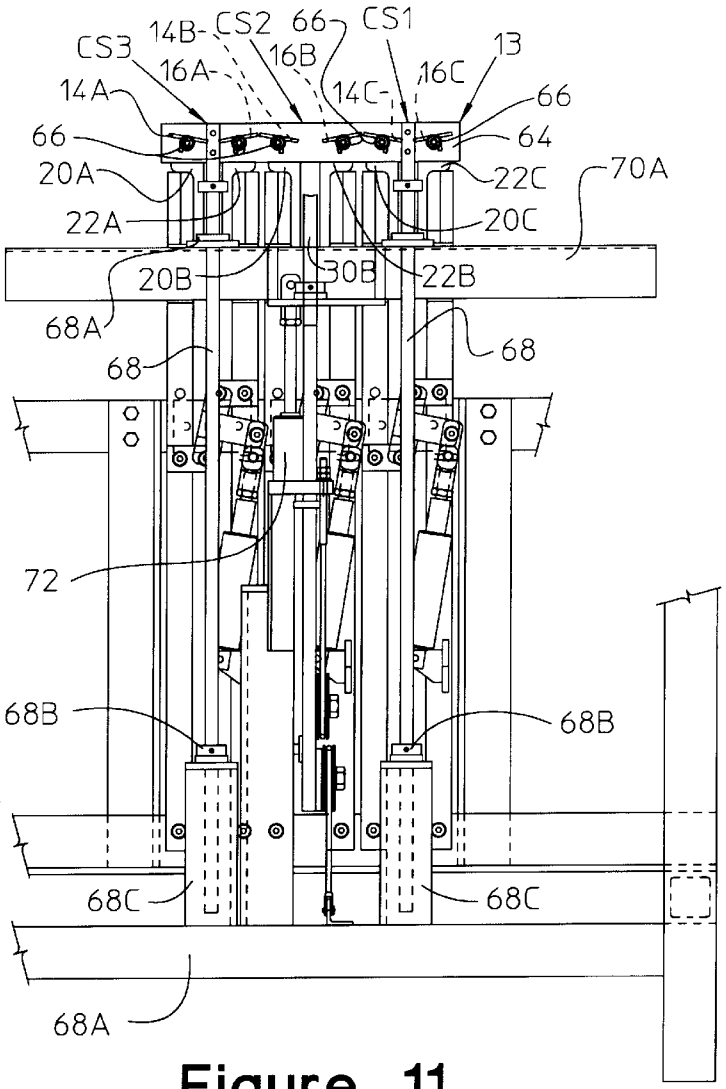
FIG. 11 is a partial elevational view taken along lines XI—XI of FIG. 9.
Figure 10:
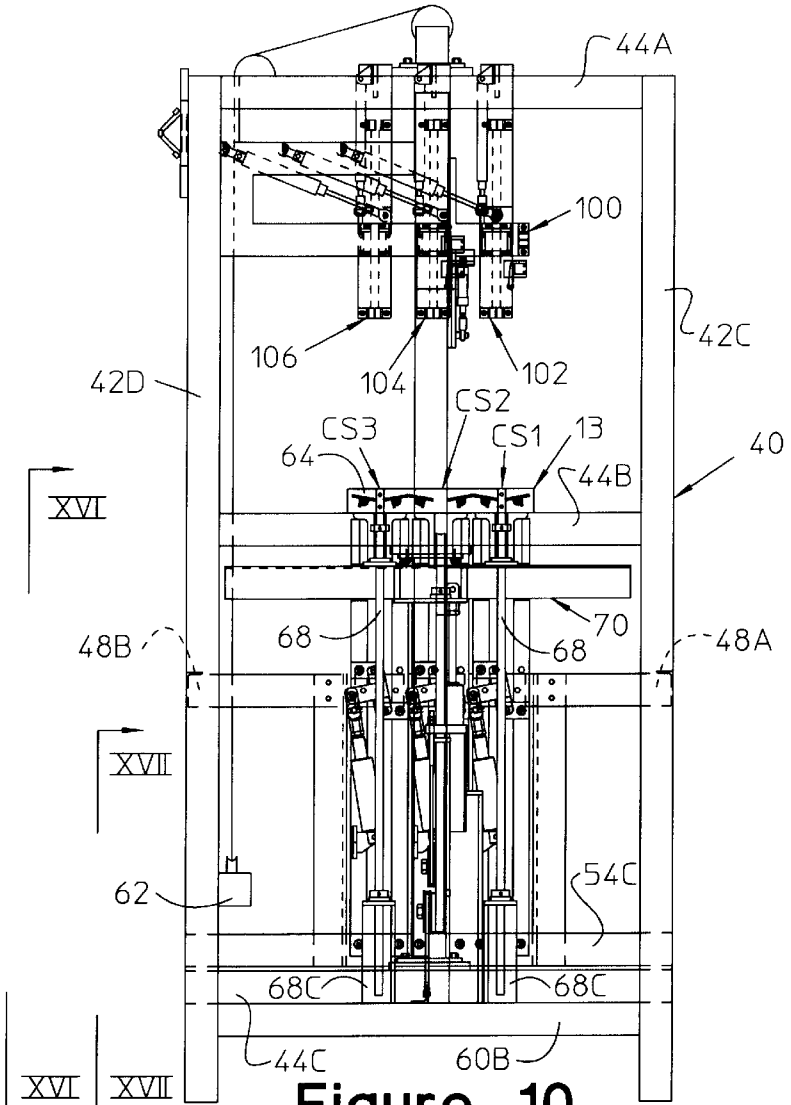
FIG. 10 is a side elevational view taken along lines X—X of FIG. 9.
Figure 12:
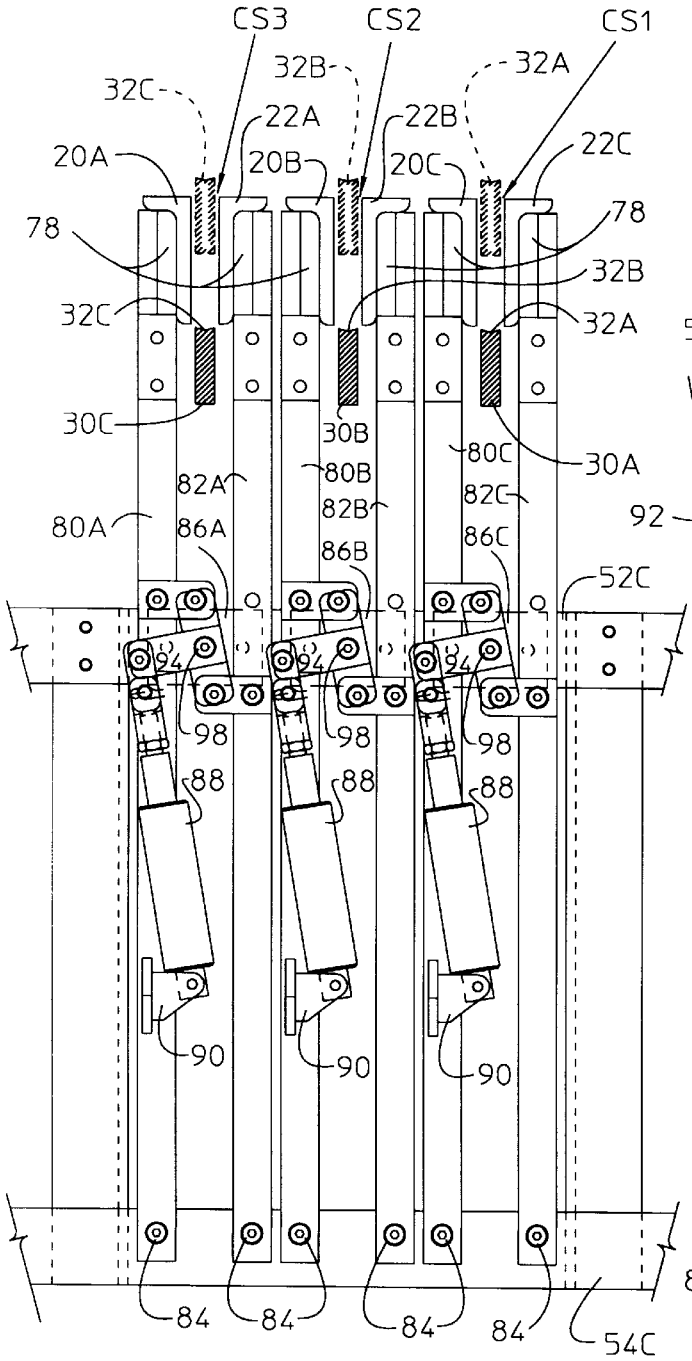
FIG. 12 is an enlarged partial elevational view taken along lines XII—XII of FIG. 9.

Presser bars 20A, 22A, 20B, 22B, 20C and 22C for the three creasing stations are shown in FIGS. 10–12. Each presser bar is elongated to extend horizontally spanning the distance between columns 50A, 50B and 50C (FIGS. 6–8) with an "L" shaped configuration in cross-section. Mounted in the gap formed by the oppositely extending legs of the "L" shaped configuration is an electrical heater 78 and outwardly thereof is a carrier bar secured to the presser bar to support the heater. The carrier bars are elongated and identified in FIG. 12 by reference numerals 80A and 82A for presser bars 20A and 22B, respectively; reference numerals 80B and 82B for presser bars 20B and 22B, respectively; and reference numerals 80C and 82C for presser bars 20C and 22C, respectively. The carrier bar arrangement shown in FIG. 12 is provided at each of three locations along the length of the structural framework 40. These three locations are established by the "T" shaped mounting brackets 54A, 54B and 54C and to each of these mounting brackets the lower terminal end of each carrier bar is secured for pivotal movement by a pivot shaft 84 as shown typically in FIG. 12. Secured to each of the horizontal mounting plates 52A, 52B and 52C are three bearing plates 86A, 86B and 86C each arranged to transverse the gap between a pair of carrier bars 80A, 82A; 80B, 82B; and 80C and 82C with the opposite lateral edges of each of the bearing plates 86A, 86B and 86C situated between the carrier bars and the horizontal mounting plates 52A, 52B and 52C. These bearing plates provide lateral stability to the carrier bars during reciprocating movement between an open position where a gap exists between the presser bars and a closed, cloth creasing position wherein the presser bars forcibly engage cloth between the presser bars with and without the presence of crease bars.

Figure 12A:
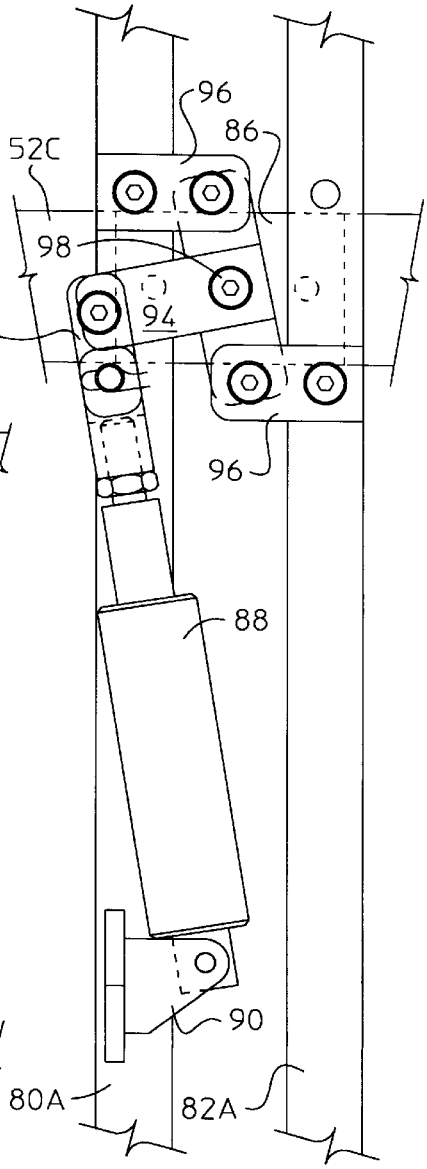
FIG. 12A is an enlarged fragmentary view of pressure bar actuating mechanism shown in FIG. 12.

The drive for moving the presser bars between the open position and the cloth creasing position is identical for each pair of carrier bars and includes, as best shown in FIG. 12A, a piston and cylinder assembly 88 of which the cylinder portion is secured by a clevis bracket 90 to a first of the carrier bars, e.g., 80A. The rod end of the piston and cylinder assembly is clevis mounted to a link 92 which in turn is connected to the central leg of a "T" shaped actuator arm 94. Opposite ends of the cross head portion of the "T" shaped actuator arm 94 are pivotally secured by links 96 to carrier bars 80A and 82A. The "T" shaped actuator arm is mounted by a pivot shaft 98 extending between carrier bar 80A and carrier bar 82A through an opening in the bearing plate 86 and into threaded engagement with the horizontal mounting plate 52C. The pairs of carrier bars are pivotally separated to form a gap between the presser bars due to a retracted position of the piston within the cylinder of the piston and cylinder assembly 88. When a pressurized fluid medium is introduced to operate the piston and cylinder assembly, the extension of the rod portion imparts pivotal movement to the "T" shaped actuator arm 94 which in turn pivots the carrier bars toward each other about their pivot shafts 84. Also shown in FIG. 12 is the crease support bars 30A, 30B and 30C in their retracted position between each pair of carrier bars and as shown by broken lines in their operative position wherein the troughs 32A, 32B and 32C, respectively, project above presser bars.

As described previously in regard to FIGS. 1–5, the present invention includes at a cloth crease station a crease blade and discharge nozzle for liquid filler material. As shown in FIGS. 9 and 10, there is provided a carriage assembly 100 which supports three spaced apart crease bar and filler material applicator subassemblies 102, 104 and 106 used with the crease stations CS1, CS2 and CS3, respectively. The opposite ends of the carriage assembly 100 are provided with a linear bearing 108 for travel along the linear bearing tracks 56C and 58C while suspended by cables 110 and 112 forming part of cable drive system for vertically positioning the carriage assembly relative to the cloth support table 13.

The details of the construction of the carriage assembly 100 are shown in FIGS. 19–22 and at each end of the carriage assembly, the linear bearing 108 is mounted on a carrier plate 114 that is in turn secured to one of the respective cables 110 and 112 by clamp bars 116. The carrier plates 114 are each constructed with a configuration resembling the numeral 4 by the provision of a "C" shaped section 114A extending to a vertically arranged carrier section 114B and a protruding horizontal section 114C which is an extension of the lower leg of "C"shaped section 114A. Face surfaces of sections 114B directed toward linear tracks 56C and 58C are mounted to the linear bearings 108. Mounted on the face surfaces of carrier plates 114, which are opposite the face surfaces directed toward the linear tracks 56C and 58C are spaced apart carrier brackets 118 and 120 located in the lower leg portion of section 114A and extension 114C. At each end of the carriage assembly the brackets 118 and 120 form a mounting structure for supporting a horizontally extending support rod 122. Slidably supported on the support rod 122 are three independently moveable carrier slides 124, 126 and 128 which form part of the crease bar and filler material applicator assemblies 102, 104 and 106, respectively. The carrier slides 124, 126 and 128 are horizontally moveable along support rod 122 by piston and cylinder assemblies 130, 132 and 134, respectively, having their respective cylinder ends mounted by bolts 136 pass through stand off sleeves 138 to the upper leg of the "C" shaped section 114A. The rod ends of piston and cylinder assemblies 130, 132 and 134 are secured by clevis mountings 130A, 132A and 134A to the carrier slides 124, 126 and 128 respectively.

The carrier slides 124, 126 and 128 include elongated vertical guide tube sections 140, 142 and 144, respectively, that in turn slidably receive vertically arranged slide rods 146, 148 and 150. The opposite ends of the vertically arranged support rods 146, 148 and 150 are secured by mounting blocks 146A, 148A and 148A to an upstanding mounting plates 152, 154 and 156, respectively. The mounting plates 152, 154 and 156 at each of the opposite ends of the carriage assembly 100 are mechanically interconnected by parallel and horizontal linear guide tracks 158, 160 and 162, respectively. Parallel with and spaced from the linear bearings are crease blade 18A, 18B and 18C that are mechanically interconnected with the respective ones of the mounting plates 152, 154 and 156. The crease bars are independently reciprocated vertically with the associated ones of the mounting plates 152, 154 and 156 by operation of piston and cylinder assemblies 164, 166 and 168, respectively. The cylinder ends of piston and cylinder assemblies 164, 166 and 168 are clevis mounted to brackets attached to the upper ends of mounting plates 152, 154 and 156, respectively. The cylinder ends of piston and cylinder assemblies 164, 166 and 168 are mounted by clevis brackets 164A, 166A and 168A to the upper ends of mounting plates 152, 154 and 156, respectively. The rod ends of piston and cylinder assemblies 164, 166 and 168 are mounted by bolts 164B, 166B and 168B to the carrier slides 124, 126 and 128, respectively.

Figure 19:
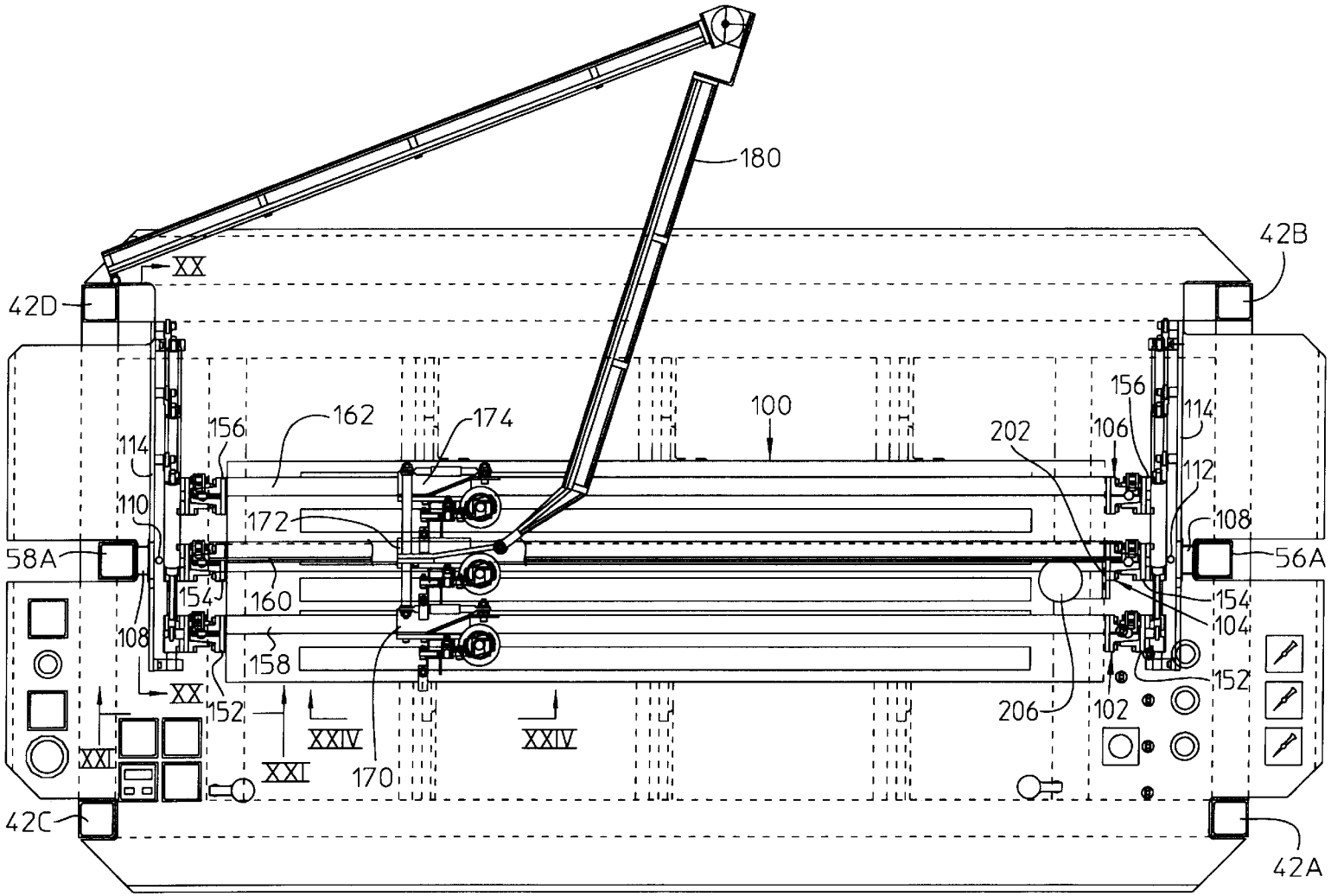
FIG. 19 is a plan view taken along lines XIX—XIX of FIG. 9.
Figure 20:
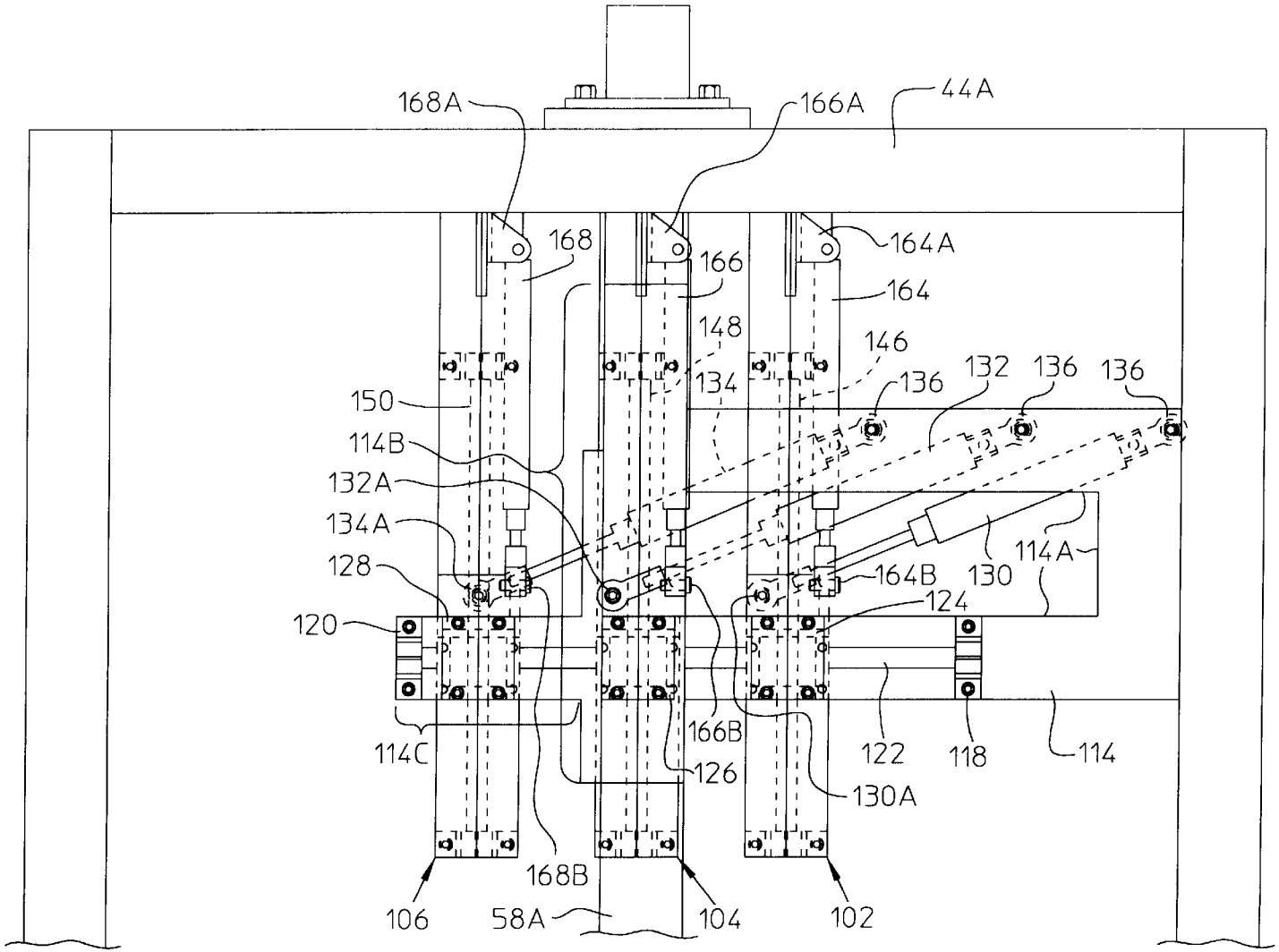
FIG. 20 is an enlarged partial elevational view taken along lines XX—XX of FIG. 19.
Figure 21:
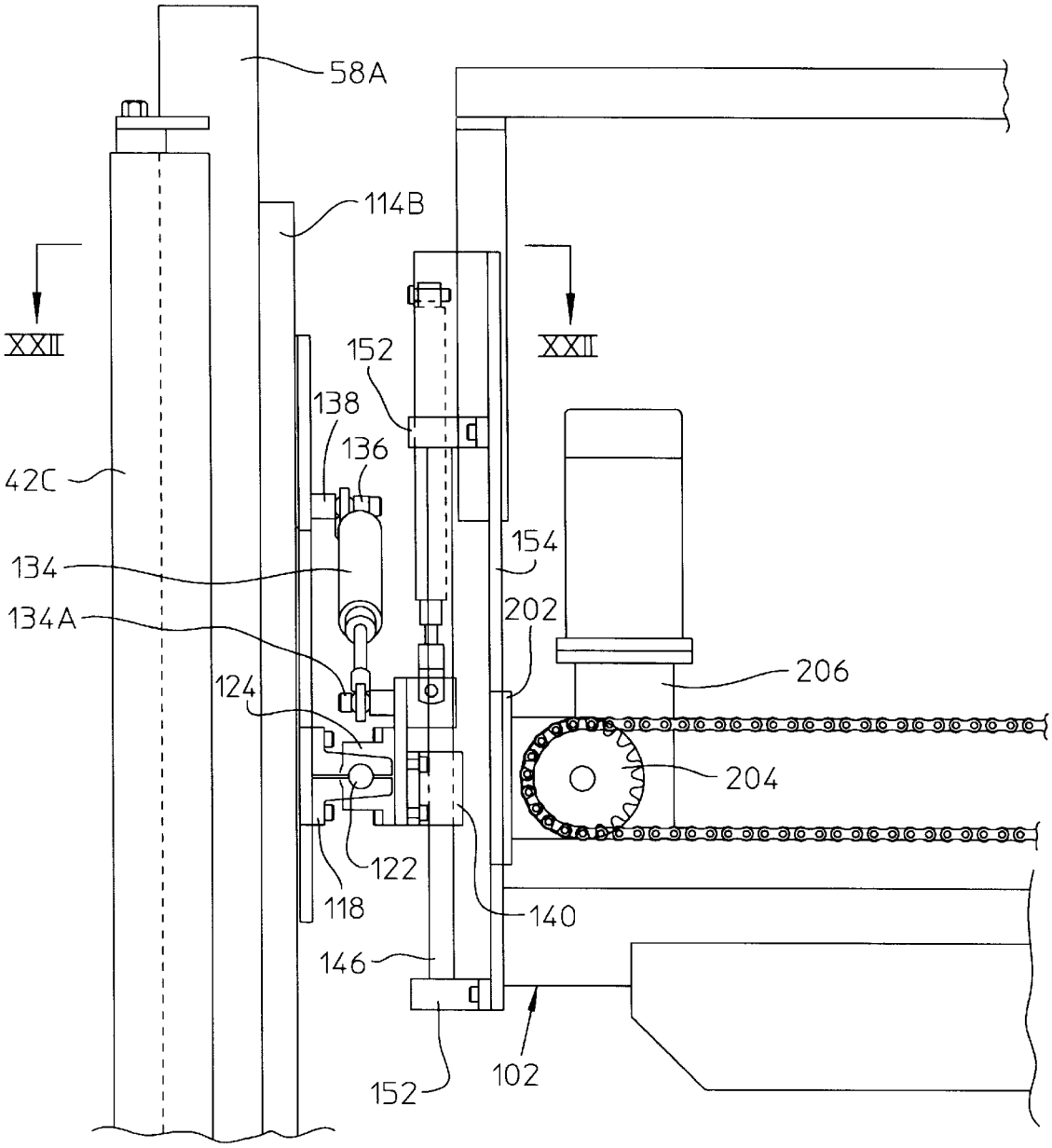
FIG. 21 is an enlarged front elevational view taken along lines XXI—XXI of FIG. 19.
Figure 22:
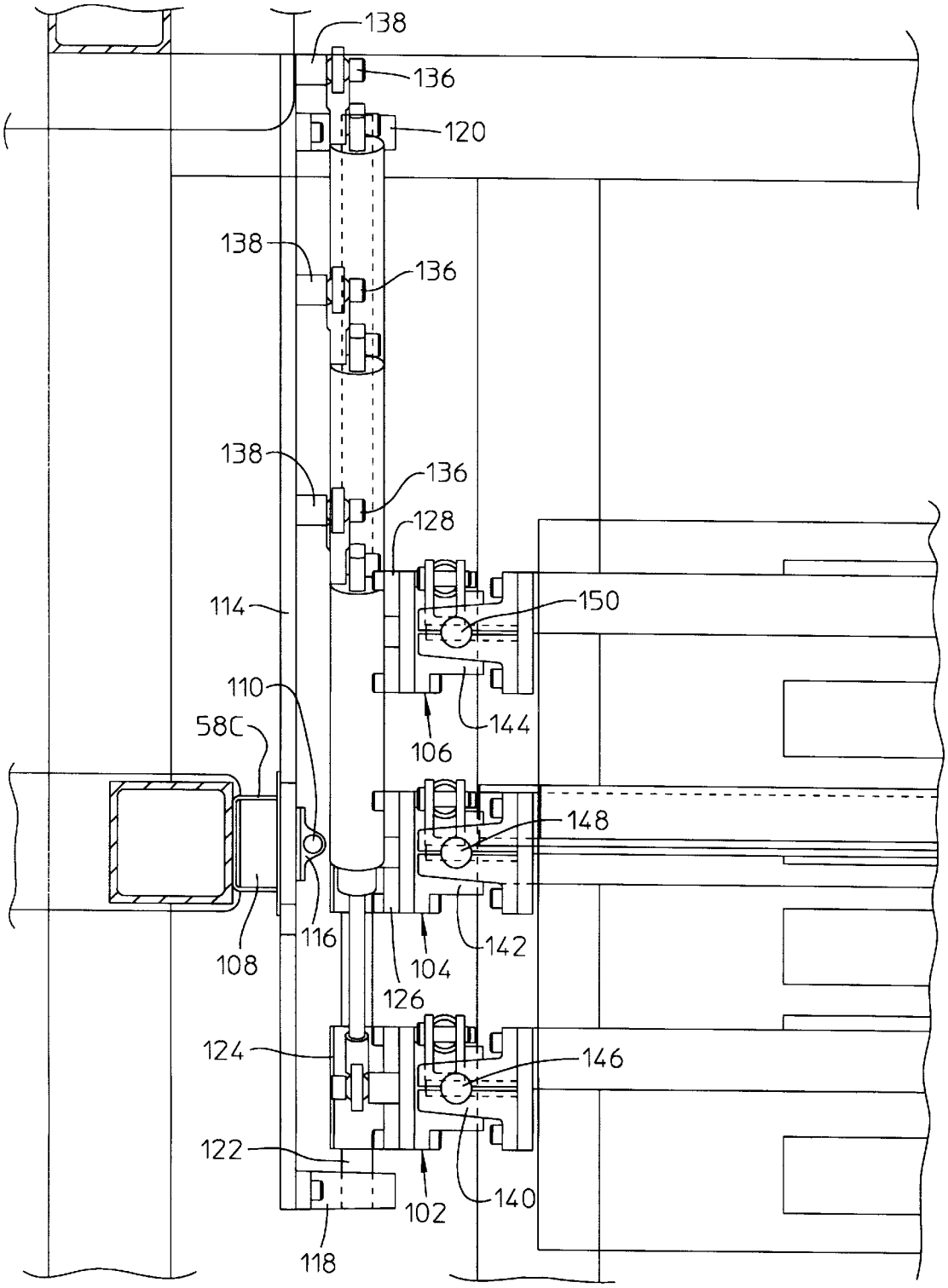
FIG. 22 is an enlarged plan view taken along lines XXII—XXII of FIG. 21.
Figure 24:
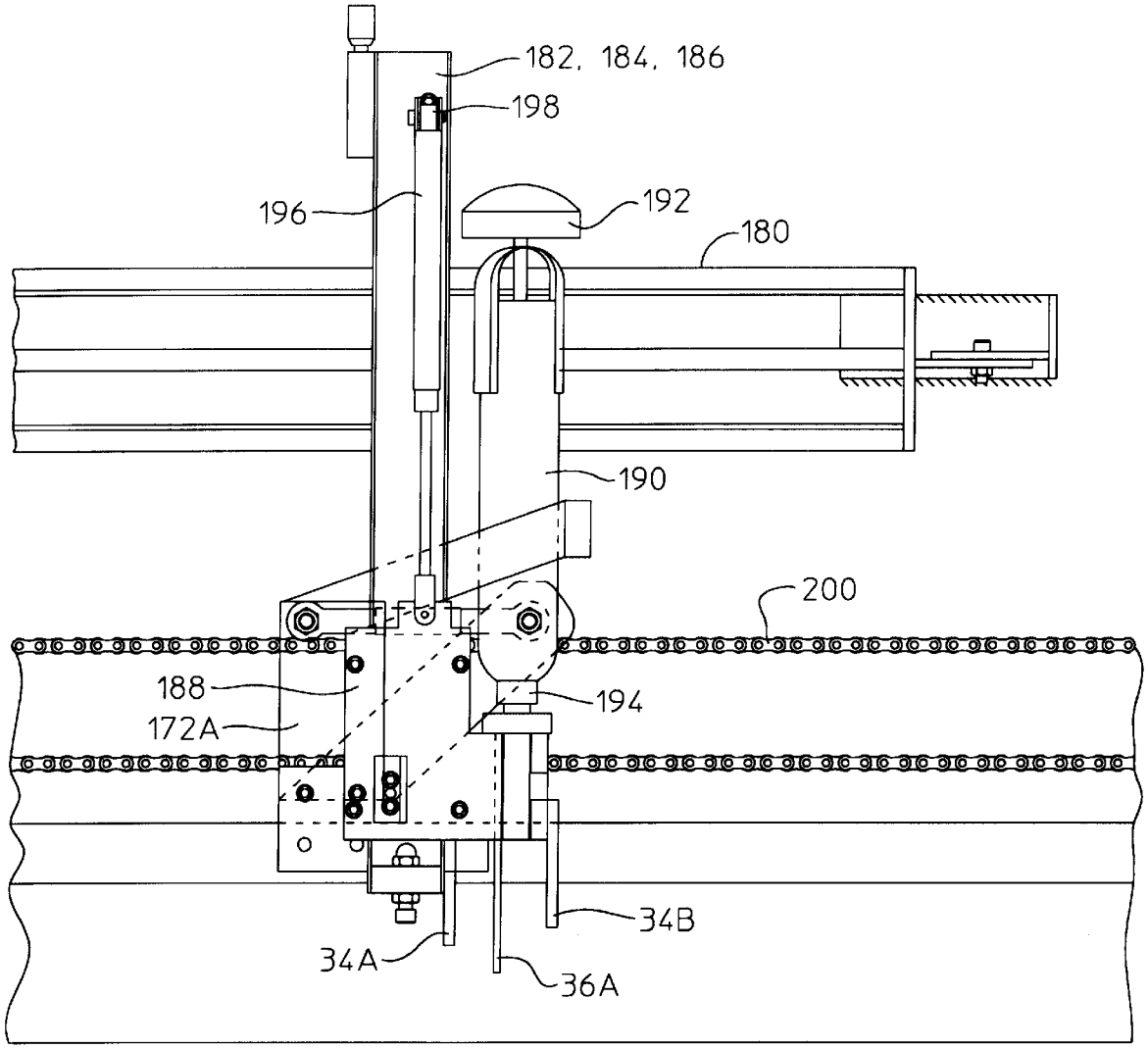
FIG. 24 is an enlarged elevational view of the filler material applicator taken along lines XXIV—XXIV of FIG. 19.
Figure 25:
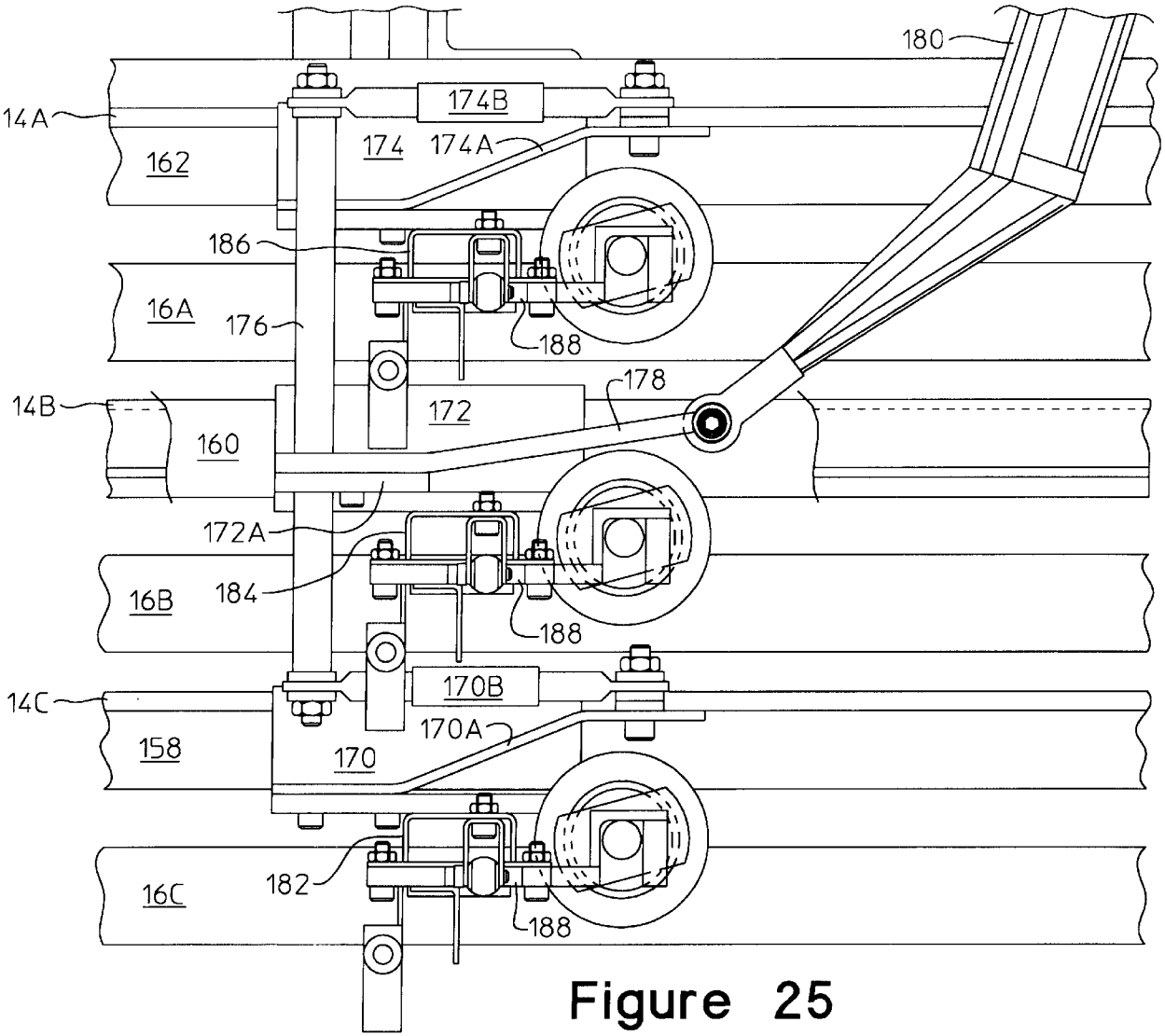
FIG. 25 is an enlarged plan view of the filler material applicator shown in FIG. 24.

As best shown in FIGS. 19, 24 and 25, the linear guide tracks 158, 160 and 162 are provided with linear bearings housed in carrier blocks 170, 172 and 174, respectively. Reversely bent brackets 170A and 174A are bolted to the respective carrier blocks 170 and 174 which are interconnected by links 170B and 174B joined with a tie bar 176. The tie bar 176 is connected with a vertically extending tie plate 172A bolted to carrier block 172. The arrangement is such that the carrier blocks 170, 172 and 174 are mechanically interconnected to move in unison along their respective linear guide tracks 158, 160 and 162. Utilities for operatively controlling the applicators for the liquid crease filler material are supplied to the mechanically interconnected carrier blocks through a support arm 178 also connected to the tie plate 172A and joined with a flexible gantry arm 180.

Linear bearing tracks 182, 184 and 186 are mounted to extend vertically from a horizontal face of carrier blocks 170, 172 and 174, respectively. Each of the linear bearing tracks 182, 184 and 186 slidably support a linear bearing secured to a face plate 188 to which there is mounted a canister 190 containing a supply of liquid filler material. Pneumatic pressure is controllably applied in an ON/OFF fashion to the liquid filler material by an air delivery tube 192 at one end of the canister for controlled discharge of the filler material through a conduit 194 to a discharge nozzle 36. Forward and aft of each discharge nozzle 36A are air discharge nozzles 34A and 34B. Air streams from the nozzles impinge on the cloth to urge the cloth into assist in the supporting engagement of the cloth against the crease support bars 30A, 30B and 30C. Each of the face plates 188 are vertically positionable and thus also the discharge nozzles 36A by operation of piston and cylinder assembly 196 mounted by a clevis 198 to the upper end portion of the associate one of the linear bearing tracks 182, 184 and 186. The rod end of each piston and cylinder assembly 196 is clevis mounted to the face plate 188. The movement of the carrier blocks 170, 172 and 174 in unison is accomplished by a trolley drive that includes an endless silent chain 200 arranged with horizontal runs having terminal ends secured to tie plate 172A. An idler sprocket is rotatably supported by a bracket secured to face surface of mounting plate 154 at one end of the carriage assembly and at the other end of the carriage assembly there is a bracket 202 secured to a mounting plate 154 that supports a drive motor 206 having a drive sprocket 204 engaged with the silent chain 200.

Figure 18:
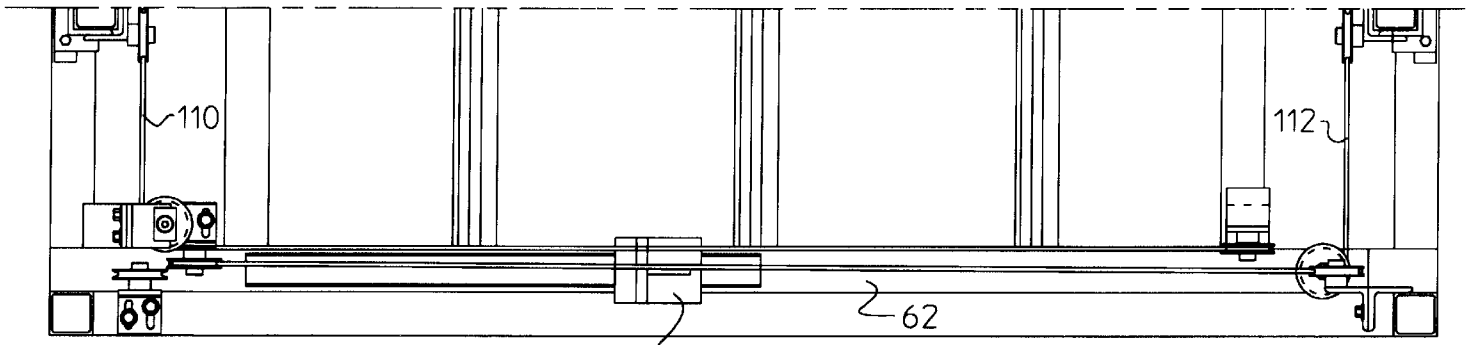
FIG. 18 is a plan view taken along lines XVIII—XVIII of FIG. 16.
Figure 17:
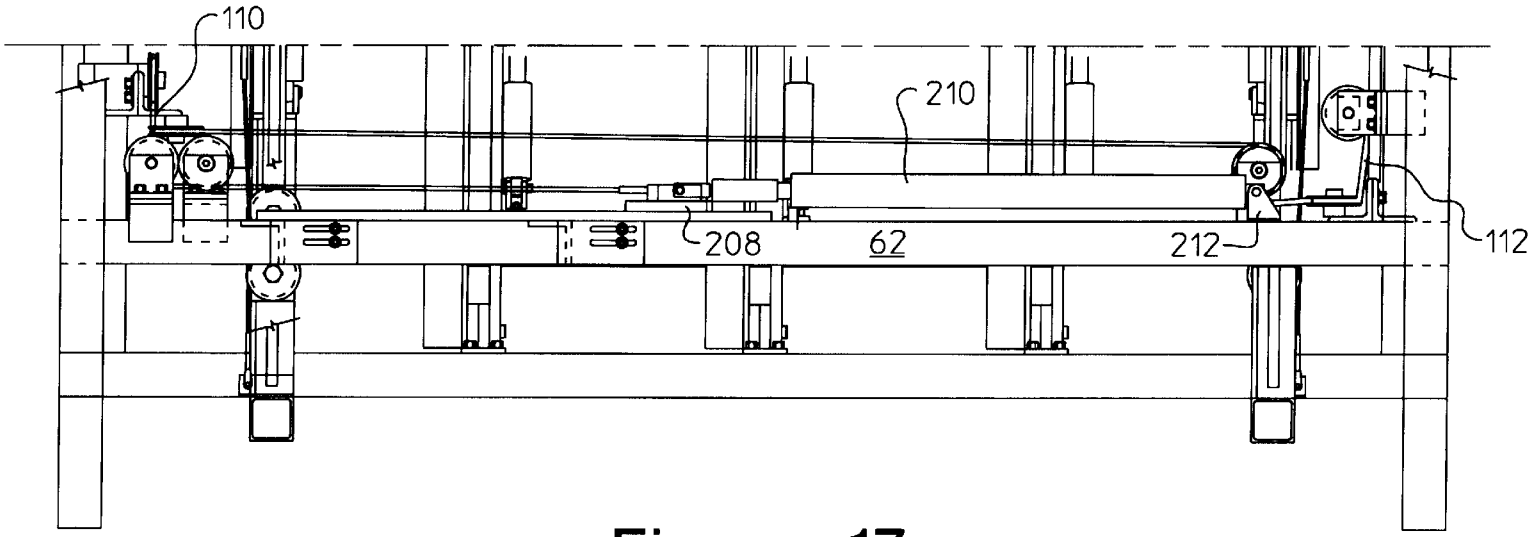
FIG. 17 is an elevational view taken along lines XVII—XVII of FIG. 16.
Figure 23:
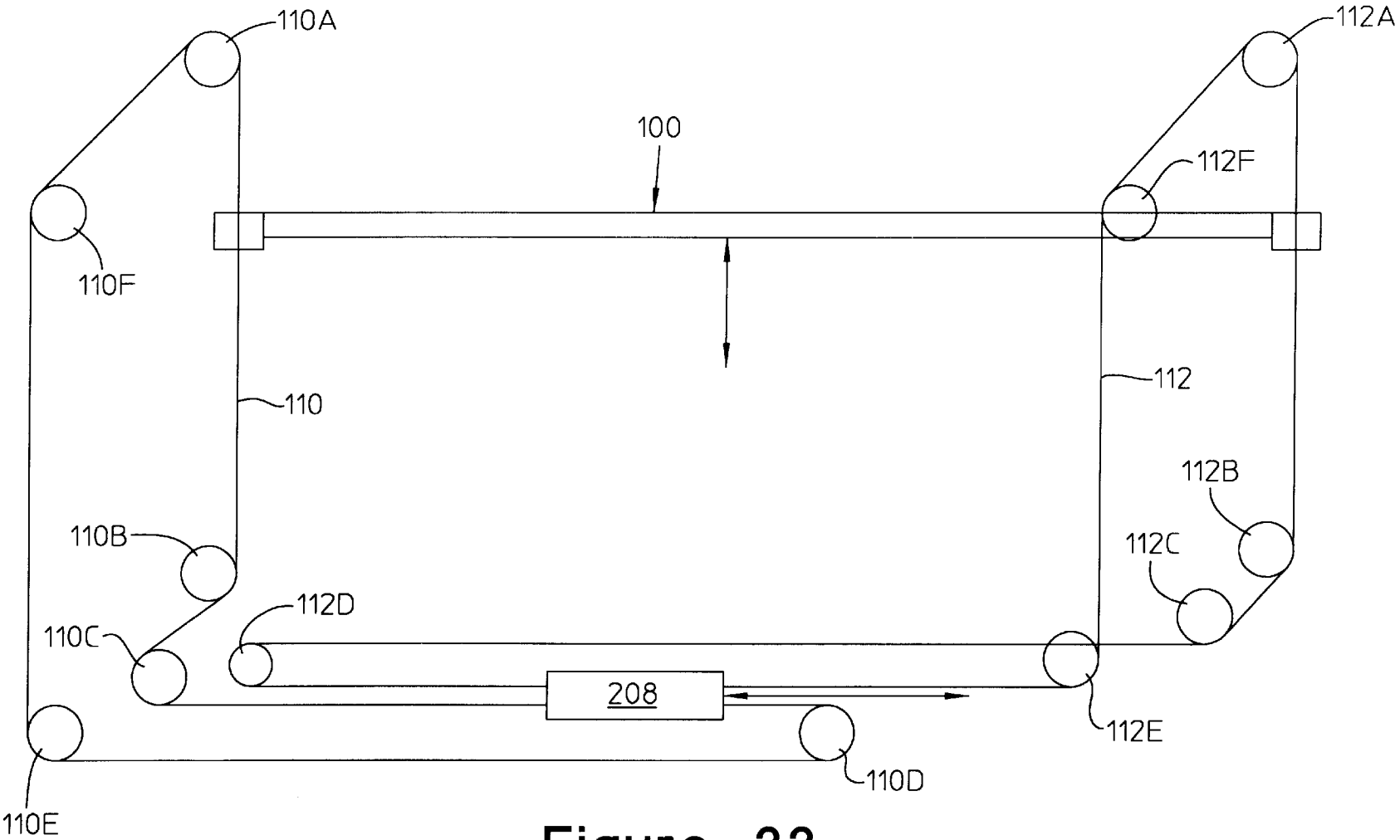
FIG. 23 is a schematic illustration of the cable drive system for lowering a carriage carrying crease blades and filler material applicators from an elevated position to an operative position which is closely proximate a cloth on the cloth support table of the present invention.

As noted previously, the carriage assembly is suspended by cables 110 and 112 which form part of a cable drive system shown schematically in FIG. 23. The cables 110 and 112 are clamped to the carriage assembly 100 and extend upwardly to pulleys 110A and 112A, respectively, rotatably supported on the upper ends of support tubes 58A and 56A, respectively. The cables have runs extending downwardly from the carriage and wrap about pulleys 110B and 112B which direct the cable runs to the rear of the machine. Pulley 110C directs the cable 110 to a slide block 208 and pulleys 112C and 112D direct the cable 112 to an end of a slide block 208. The opposite end of the slide block 208 is connected with cable 112 extending to a pulley 112E and thence to pulley 112F situated on the upper end of a rear column for completing the run of cable 112 to pulley 112A. Slide block 208 is joined to the free end of cable 110 which wraps about a reversing pulley 110D and thence extends to pulley 110E which directs the cable vertically to pulley 110F rotatably supported on the upper end of the column at the rear of the machine. The slide block 208 is reciprocated horizontally by a piston and cylinder assembly forming push/pull cable circuits. In FIGS. 17 and 18, there is illustrated a piston and cylinder assembly 210 mounted by a clevis 212 to carriage drive support bar 62. The rod end of the piston and cylinder assembly to secured to the slide block 208.

As shown in FIG. 9, the carriage assembly 100 is secured in the raised, inoperative position by latch plates 100A that are pivoted about support shafts by piston and cylinder assemblies 100B to position an upper edge of the latch plates into a position for preventing downward travel of vertically arranged carrier sections 114B and thereby also carriage assembly 100. When it is desired to lower the carriage assembly to an operative position, the piston and cylinder assemblies 100B are operated to pivot the latch plates out of the path of travel by the vertically arranged carrier sections 114B.

The method of the present invention preferably utilizes the apparatus herein before illustrated and described for providing creases in a cloth. The select cloth is arranged along table 13 which forms an undulating course traversing the elongated gaps between the table support plates 14A, 16A, 14B, 16B, 14C and 16C of the spaced apart crease stations CS1, CS2 and CS3. Piston and cylinder assembly 210 is then operated to lower the carriage assembly 100 to a position closely spaced from the cloth support table 13. First reversely extending cloth portions are formed by displacing the crease blade 18B in a vertical direction downwardly from the carriage assembly through operation of piston and cylinder assembly 166 to displace a first part of the cloth through the gap between table support plates 14B and 16B and into the elongated gap between presser members 20B and 22B. The associated piston and cylinder assembly 88 is operated to grip the reversely extended cloth portions residing in the elongated gap between the presser members 20B and 22B. Thereafter second, and when desired, third reversely extending cloth portions are displaced by crease blades 18A and 18C by operation of piston and cylinder assemblies 164 and 168, respectively through the respective gaps between table support plates 14A, 16A and 14C, 16C and into the elongated gaps between presser members 20A, 22A and 20C, 22C. Whereupon creases are formed between each of the reversely extending cloth portions residing in the elongated gaps between all three pairs of the presser members to form three elongated crease lines.

The crease blades 18A, 18B and 18C are lifted vertically by operation of the piston and cylinder assemblies 164, 166 and 168 to an inoperative position spaced above the cloth support table. After the crease bars are removed from the gaps between the presser members, an increased force is applied to each pair of the presser members by the supply of fluid medium at a greater pressure to the piston and cylinder assemblies 88. Thereafter, the presser members are separated forming gaps therebetween to allow the crease support bars 30A, 30B and 30C to be elevated into supporting contact with the various crease lines through operation of piston and cylinder assemblies 72. These piston and cylinder assemblies may also be operated to lift the cloth support table vertically a distance sufficient to allow a desired redistribution of the cloth on the support table while the creases therein remain supported along the crease lines.

The support of the creases by the crease support bars causes the reversely extending cloth portions to unfold and expose the notch of each of the crease lines. There piston and cylinder assemblies 130, 132 and 134 are operated to horizontally shift each of the moveable carrier slides 124, 126 and 128 of the crease bar and filler material applicator assemblies 102, 104 and 106 on support rods 122 which laterally shifts each of the crease blades 18A, 18B and 18C from a vertically aligned relation with the gaps between the table plates and brings into a vertically aligned relation the respective discharge nozzle 36A with the crease lines in the cloth. Piston and cylinder assemblies 196 are then operated to displace face plate 188 of each filler applicator along the vertical linear bearing track such that each nozzle 36A is in close proximity with the associated crease line. Drive motor 206 is then operated to advance the carrier blocks 170, 172 and 174 in unison thereby also advancing the discharge nozzles while streams of air are discharged from nozzles 34A and 34B forward and aft of nozzles 36A to apply pressure against the cloth in a direction to hold it tightly against the "V" shaped troughs 32A, 32B and 32C while filler material is applied along the crease line in the cloth. The filler adheres to the cloth to maintain sharp well defined crease lines of long continued integrity.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for providing a permanent crease in a cloth, said method including the steps of:

arranging a select cloth along a course traversing an elongated gap formed by spaced apart supports;

moving an elongated crease blade along a path of travel from an inoperative position remote to said elongated gap along an operative course of travel displacing a portion of cloth from said supports to a site between said spaced apart supports to form reversely extending cloth portions;

pinching the cloth in the gap between presser bars and said elongated crease blade under a sufficient force to allow withdrawing of the said crease blade from between the press bars without carrying the reversely extending cloth portion with the crease blade;

creasing the reversely extended cloth portions residing in said elongated gap between presser members to form an elongated crease line between said reversely extending cloth portions;

separating said reversely extending cloth portions by moving an elongated crease support bar vertically between the presser members to support, expose and align said elongated crease line; and adhering a filler to the select cloth along at least a part of said elongated crease line to establish a permanent crease of long continued integrity.

2. The method according to claim 1 including the further step of heating said reversely extending cloth portions residing in said gap between presser members while forming said elongated crease line.

3. The method according to claim 1 wherein said step of separating includes supporting the cloth along said elongated crease line with said reversely extending cloth portions diverging outwardly to expose said elongated crease line therebetween.

4. The method according to claim 1 wherein said step of separating includes supporting the cloth along said elongated crease line and along parts of said reversely extending cloth portions diverging outwardly to expose said elongated crease line therebetween.

5. The method according to claim 1 including the further step of controlling the position of said reversely extending cloth portions and said crease line during said step of adhering a filler.

6. The method according to claim 1 including the further step of stabilizing the position of at least a part of each of said reversely extending cloth portions and said crease line during said step of adhering a filler.

7. The method according to claim 1 including the further step of applying pressure to bring at least a part of each of said reversely extending cloth portions and said crease line to bear against spaced apart supports for the cloth along opposite sides of the crease line during said step of adhering a filler.

8. The method according to claim 7 wherein said step of applying pressure comprises directing a stream of gaseous medium onto each of said reversely extending cloth portions.

9. The method according to claim 1 wherein said course is undulating and includes angled cloth engaging surfaces sloping toward said spaced apart supports.

10. A method for providing permanent creases in a cloth, said method including the steps of:

arranging a select cloth along a course traversing a plurality of spaced apart and elongated gaps between support members;

moving a first elongated crease blade along a path of travel from an inoperative position remote to said elongated gap along an operative course of travel displacing a first portion of cloth from said supports to a site between a first of said spaced apart and elongated gaps to form a first reversely extending cloth portion;

pinching the cloth in the gap between presser bars and said first elongated crease blade under a sufficient force to allow withdrawing of said first crease blade from between the press bars without carrying the first reversely extending cloth portion with the crease blade;

gripping the reversely extended cloth portions residing in said elongated gap between said presser members;

moving a second elongated crease blade along a path of travel from an inoperative position remote to said elongated gap along an operative course of travel displacing a second portion of cloth from said supports to a site between a second of said spaced apart and elongated gaps to form second reversely extending cloth portion, pinching the cloth in the gap between presser bars and said second elongated crease blade under a sufficient force to allow withdrawing of the said second crease blade from between the press bars without carrying the second reversely bent portion of cloth with the crease blade;

creasing said first and second reversely extending cloth portions residing in said plurality of elongated gaps between each of said first and second presser members to form elongated first and second crease lines;

separating said first and second reversely extending cloth portions by moving elongated crease support bars vertically between each of the first and second presser members to support, expose and align said elongated first and second crease lines; and adhering a filler along at least a part of each of said first and second elongated crease lines to the select cloth to establish permanent creases in the cloth of long continued integrity.

11. The method according to claim 10 including the further step of heating said first and second reversely extending cloth portions residing in said plurality of elongated gaps between each of said first and second presser members while forming said elongated first and second crease lines.

12. The method according to claim 10 wherein said step of separating includes supporting the cloth along each of said first and second elongated crease lines with said first and second reversely extending cloth portions diverging outwardly to expose each of said elongated first and second crease lines.

13. The method according to claim 10 wherein said step of separating includes supporting the cloth along said first and second elongated crease lines and along parts of said first and second reversely extending cloth portions diverging outwardly to expose said first and second elongated crease lines.

14. The method according to claim 10 including the further step of controlling the position of each of said first and second reversely extending cloth portions and said first and second crease lines during said step of adhering a filler.

15. The method according to claim 10 including the further step of stabilizing the position of at least a part of each of said first and second reversely extending cloth portions and said first and second crease lines during said step of adhering a filler.

16. The method according to claim 10 including the further step of applying pressure to bring at least a part of each of said first and second reversely cloth portions and said first and second crease lines to bear against spaced apart supports for the cloth along opposite side of each said crease lines during said step of adhering a filler.

17. The method according to claim 16 wherein said step of applying pressure comprises directing a stream of gaseous medium onto each of said first and second reversely extending cloth portions.

18. The method according to claim 10 wherein said course is undulating and includes angled support surfaces sloping toward said plurality of spaced apart and elongated gaps.

19. The method according to claim 10 including the further step of lifting the select cloth along said crease line while the first and second reversely extending cloth portions are independently supported to expose each of the first and second crease lines.

20. An apparatus to form a military crease in cloth, said apparatus including the combination of:

an elongated cloth support having at least one gap for passage of a folded portion of cloth;

elongated press bars movable to a spaced apart relation to receive a select portion of cloth passed from the gap in said cloth supports;

a press bar actuator connected to said press bars for creasing a portion of cloth between said press bars;

an elongated crease blade reciprocal along a generally path of travel between an inoperative position remote to said elongated cloth support and an operative course of travel to displace a portion of cloth from said support to a site between said press bars;

an elongated crease support bar for unfolding the reversely extending cloth portion while supporting the cloth along a crease line;

a crease support bar actuator for moving said elongated crease support bar between a cloth receiving position between said press bars and a filler applicator position; and an applicator for discharging a filler along said crease line while supported by said elongated crease support bar.

21. The apparatus according to claim 20 further including a carriage assembly for supporting said elongated crease blade, a drive for displacing said carriage assembly between an inoperative position and an operative position wherein said crease blade is reciprocal along said generally parallel path between said inoperative position and said operative course of travel.

22. The apparatus according to claim 21 wherein said carriage assembly includes carrier brackets supporting said elongated crease blade and said applicator, and an actuator operatively connected to said carrier brackets for selectively positioning said elongated crease blade and said applicator into an aligned relation with said at least one gap of said elongated cloth support.

23. The apparatus according to claim 22 further including a drive for vertically displacing said carriage between an inoperative position and an operative position closely spaced from said elongated cloth support.

24. The apparatus according to claim 23 wherein said drive includes cables secured to said carriage and to a actuator.

25. The apparatus according to claim 21 further including support members engaged with said elongated cloth support for displacement thereof between a cloth creasing position and a position for applying filler along said crease line by said applicator.

26. The apparatus according to claim 20 further including at least one member arranged to apply a force to said cloth for stabilizing and holding the cloth while support by said crease support bar during the discharge of a filler by said applicator.

27. The apparatus according to claim 20 further including a trolley drive for displacing said applicator along a crease line while support by said elongated crease bar.

28. The apparatus according to claim 21 further including latch members moveable into a position for preventing travel of said carriage assembly toward said elongated cloth support and an inoperative position to allow such travel of the carriage toward the cloth support.

* * * * *